US011212020B2

(12) United States Patent
Gu et al.

(10) Patent No.: US 11,212,020 B2
(45) Date of Patent: Dec. 28, 2021

(54) FM CHANNEL FINDING AND SEARCHING METHOD, MOBILE TERMINAL AND STORAGE APPARATUS

(71) Applicant: HuiZhou TCL Mobile Communications Co., Ltd., HuiZhou (CN)

(72) Inventors: Qicai Gu, HuiZhou (CN); Lei Shi, HuiZhou (CN); Qiqi Lin, HuiZhou (CN); Yanming Lai, HuiZhou (CN); Hua Zhang, HuiZhou (CN); Danping Guo, HuiZhou (CN)

(73) Assignee: HuiZhou TCL Mobile Communication Co., Ltd., HuiZhou (CN)

( * ) Notice: Subject to any disclaimer, the term of this patent is extended or adjusted under 35 U.S.C. 154(b) by 35 days.

(21) Appl. No.: 16/628,038

(22) PCT Filed: Jul. 12, 2018

(86) PCT No.: PCT/CN2018/095451
§ 371 (c)(1),
(2) Date: Jan. 2, 2020

(87) PCT Pub. No.: WO2019/011297
PCT Pub. Date: Jan. 17, 2019

(65) Prior Publication Data

US 2021/0143926 A1 May 13, 2021

(30) Foreign Application Priority Data

Jul. 12, 2017 (CN) ..... 201710564631.X

(51) Int. Cl.
*H04H 60/43* (2008.01)
*H04H 60/46* (2008.01)

(52) U.S. Cl.
CPC ..... *H04H 60/43* (2013.01); *H04H 60/46* (2013.01)

(58) Field of Classification Search
CPC ..... H04N 2005/44517; H04N 21/4345; H04N 21/4622; H04N 21/47; H04N 21/47214;
(Continued)

(56) References Cited

U.S. PATENT DOCUMENTS 5,291,475 A * 3/1994 Bruckert ..... H04B 1/713 370/330
8,640,170 B2 1/2014 Klosterman
(Continued)

FOREIGN PATENT DOCUMENTS

CN 1933587 2/2007
CN 101087145 12/2007
(Continued)

OTHER PUBLICATIONS

International Search Report and the Written Opinion dated Sep. 28, 2018 From the International Searching Authority Re. Application No. PCT/CN2018/095451 and Its Translation of Search Report Into English. (10 Pages).

*Primary Examiner* — Tan H Trinh

(57) ABSTRACT

Disclosed in the present invention are an FM channel finding and searching method, a mobile terminal and a storage apparatus. By means of establishing a data table of different channels and priority levels of corresponding numbers of times connecting thereto or pre-determined priority levels, ordering current FM channel information by priority level according to the data table, and acquiring an updated channel list, then loading and displaying corresponding channels, thereby increasing speed of a user finding and searching FM channels, and making use more convenient.

20 Claims, 2 Drawing Sheets

(58) Field of Classification Search
CPC ..... H04N 21/482; H04N 21/4821; H04N 21/485; H04N 21/84; H04N 5/44543; H04N 5/505; H04N 7/163
USPC ..... 455/41.1, 41.2, 41.3, 63.3, 61, 179.1, 455/434, 414.2; 370/330, 340, 350, 464
See application file for complete search history.

(56) References Cited

U.S. PATENT DOCUMENTS

2004/0031050 A1 2/2004 Klosterman
2004/0248561 A1* 12/2004 Nykanen ..... H04W 72/02 455/414.2
2007/0014536 A1* 1/2007 Hellman ..... G11B 27/105 386/259
2007/0241806 A1* 10/2007 Pedersen ..... H03H 17/0223 327/335
2007/0288961 A1* 12/2007 Guldi ..... H04N 21/466 725/46
2008/0233325 A1* 9/2008 Pahl ..... B32B 27/10 428/41.4
2008/0233883 A1* 9/2008 Ibrahim ..... H03L 7/181 455/61
2008/0233954 A1* 9/2008 Ibrahim ..... H03L 7/181 455/434
2009/0168800 A1* 7/2009 Leinonen ..... H04B 1/3805 370/464
2010/0330941 A1* 12/2010 Trikha ..... H04H 40/45 455/180.1
2011/0051868 A1* 3/2011 Roufoogaran ..... H04B 1/18 375/350
2011/0096874 A1* 4/2011 Walsh ..... H04H 40/18 375/340
2011/0105031 A1* 5/2011 Cheng ..... H04H 20/62 455/41.3
2011/0187596 A1* 8/2011 Rao ..... G06F 11/10 342/357.66
2011/0194699 A1* 8/2011 Baker ..... H04H 40/72 381/3
2012/0202424 A1* 8/2012 Kim ..... H04M 1/72442 455/41.1
2013/0287076 A1* 10/2013 Afsahi ..... H03F 1/0266 375/221
2013/0287212 A1* 10/2013 Marko ..... H04H 20/74 381/2
2013/0309986 A1* 11/2013 Cox ..... H04H 20/55 455/179.1
2015/0072623 A1* 3/2015 Mofidi ..... H04B 1/1027 455/63.3
2020/0244772 A1* 7/2020 Luo ..... H04L 67/10

FOREIGN PATENT DOCUMENTS

CN 102324993 1/2012
CN 102510319 6/2012
CN 102857349 6/2012
CN 102739334 10/2012
CN 102843610 12/2012
CN 103188026 7/2013
CN 103442285 12/2013
CN 104935968 9/2015
CN 105611366 5/2016
CN 106028126 10/2016
CN 107171759 9/2017
WO PCT WO 2019/011297 1/2019

* cited by examiner

FM CHANNEL FINDING AND SEARCHING METHOD, MOBILE TERMINAL AND STORAGE APPARATUS

RELATED APPLICATION

This application is a National Phase of PCT Patent Application No. PCT/CN2018/095451 having International filing date of Jul. 12, 2018, which claims the benefit of priority of Chinese Patent Application No. 201710564631.X filed on Jul. 12, 2017. The contents of the above applications are all incorporated by reference as if fully set forth herein in their entirety.

FIELD AND BACKGROUND OF THE INVENTION

The present invention relates to a radio application technique in a mobile terminal, and more particularly, to a method for looking-up and searching for an FM channel and a related mobile terminal and a related storage device thereof.

As the progress of the mobile terminal, the mobile terminal becomes a necessary entertainment equipment in our daily life. Especially, the radio function is one of the functions of the mobile terminal, which have been frequently used by users.

The FM radio is a radio transmitting wireless signals in a frequency modulation (FM) technique. Most of the mobile terminals have an FM radio function. FM channels could be located by obtaining channel information from local broadcast FM signals. After the FM related application successfully search for the FM channels, the application arrange the FM channels in an order such that a channel table could be provided to the user. However, when the number of channels is too large, the user cannot quickly look up and search for wanted channel and thus it's not very convenient to the user. For example, if the user wants to look for the channel he uses the most, the user needs to switch pages to look up the table and spends too much time. In addition, when the FM application is activated, the conventional application often turns on the channel that the user used at last time. However, in some scenarios, the user needs to open the application and has to find the wanted channel as quickly as possible. Especially, the user may go from one city to another the city the user normally stays. Then, when the user goes back to the city, the channel stored when the user was in another city may not be used in the current city.

Therefore, the above issue needs to be solved.

SUMMARY OF THE INVENTION

One objective of an embodiment of the present invention is to provide a method for looking up and searching for an FM channel and related mobile terminal and storage device, which can establish a table, including relationships between channels and corresponding connection times priorities or predetermined priorities, performing a priority sorting on information of a searched FM channel according to the table, and obtain a channel list from the updated table and load and display a corresponding channel in the channel list. In addition, the present invention might revise the connection times of a specific channel when the user is using the specific channel and update the table accordingly. In this way, the smart search of FM channels could be accomplished. This raises the efficiency of looking up and searching for the FM channel and makes it more convenient for the user.

Optionally, the step of establishing the table, including the relationships between the channels and the corresponding connection times priorities or the predetermined priorities, and storing the table in the storage device comprises:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

Optionally, the step of setting the priorities from the most to the least according to the connection times comprises:

setting a channel having the most connection times as a top priority, setting a channel having the least connection times as a lowest priority, and setting other channels as different priorities from the most to the least according to the connection times of the other channels.

Optionally, the predetermined priority is set according to a user's setting a specific FM channel as a fixed priority.

Optionally, the step of obtaining information of a searched FM channel and looking up the table to determine whether the searched FM is in the table and performing a priority sorting to update the table if the searched FM is in the table comprises:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

Optionally, the step of obtaining information of the searched FM channel and looking up the table to determine whether the searched FM is in the table and performing the priority sorting to update the table if the searched FM is in the table comprises:

if the searched FM channel is not in the table, then performing a sorting operation according to a search order.

Optionally, the step of obtaining the channel list from the updated table and loading and displaying the corresponding channel in the channel list according to the priorities comprises:

obtaining the channel list in the updated table; and loading and displaying the corresponding channel in the channel list for a user to select an FM channel to perform a radio function.

Optionally, the step of obtaining the channel list from the updated table and loading and displaying the corresponding channel in the channel list according to the priorities further comprises:

when detecting that a user is using a specific channel, revising the connection times of the specific channel and updating the table;

when the mobile terminal again detects that the user is performing the search of FM channels, performing a look up function according to the updated table.

According to an embodiment of the present invention, a mobile terminal is disclosed. The mobile terminal comprises: a processor and a storage device electrically connected to the processor. The storage device stores programs for the processor to execute to perform operations of: establishing a table, including relationships between channels and corresponding connection times priorities or predetermined priorities, and storing the table in a storage device; obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

Optionally, the operation of establishing the table, including the relationships between the channels and the corresponding connection times priorities or the predetermined priorities, and storing the table in the storage device comprises:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

Optionally, the operation of setting the priorities from the most to the least according to the connection times comprises:

setting a channel having the most connection times as a top priority, setting a channel having the least connection times as a lowest priority, and setting other channels as different priorities from the most to the least according to the connection times of the other channels.

Optionally, the predetermined priority is set according to a user's setting a specific FM channel as a fixed priority.

Optionally, the operation of obtaining information of a searched FM channel and looking up the table to determine whether the searched FM is in the table and performing a priority sorting to update the table if the searched FM is in the table comprises:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

Optionally, operation of obtaining information of the searched FM channel and looking up the table to determine whether the searched FM is in the table and performing the priority sorting to update the table if the searched FM is in the table comprises:

if the searched FM channel is not in the table, then performing a sorting operation according to a search order.

Optionally, the operation of obtaining the channel list from the updated table and loading and displaying the corresponding channel in the channel list according to the priorities comprises:

obtaining the channel list in the updated table; and loading and displaying the corresponding channel in the channel list for a user to select an FM channel to perform a radio function.

Optionally, the operation of obtaining the channel list from the updated table and loading and displaying the corresponding channel in the channel list according to the priorities further comprises:

when detecting that a user is using a specific channel, revising the connection times of the specific channel and updating the table;

when the mobile terminal again detects that the user is performing the search of FM channels, performing a look up function according to the updated table.

According to an embodiment of the present invention, a storage device is disclosed. The storage device stores programs executable by a processor to perform operations of: establishing a table, including relationships between channels and corresponding connection times priorities or predetermined priorities, and storing the table in a storage device; obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

Optionally, the programs are executable by the processor to perform operations of:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

Optionally, the programs are executable by the processor to perform operations of:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

Optionally, the programs are executable by the processor to perform operations of:

obtaining the channel list in the updated table; and loading and displaying the corresponding channel in the channel list for a user to select an FM channel to perform a radio function.

In contrast to the conventional art, one embodiment of the present invention could Establish a table, including relationships between channels and corresponding connection times priorities or predetermined priorities, and store the table in a storage device, obtain information of a searched FM channel and look up the table to determine whether the searched FM is in the table and perform a priority sorting to update the table if the searched FM is in the table; and obtain a channel list from the updated table and load and display a corresponding channel in the channel list according to the priorities. In addition, one embodiment of the present invention could establish a table, including relationships between channels and corresponding connection times priorities or predetermined priorities, performing a priority sorting on information of a searched FM channel according to the table, and obtain a channel list from the updated table and load and display a corresponding channel in the channel list. In addition, the present invention might revise the connection times of a specific channel when the user is using the specific channel and update the table accordingly. In this way, the smart search of FM channels could be accomplished. This raises the efficiency of looking up and searching for the FM channel and makes it more convenient for the user.

DESCRIPTION OF SPECIFIC EMBODIMENTS OF THE INVENTION

Figure 1:
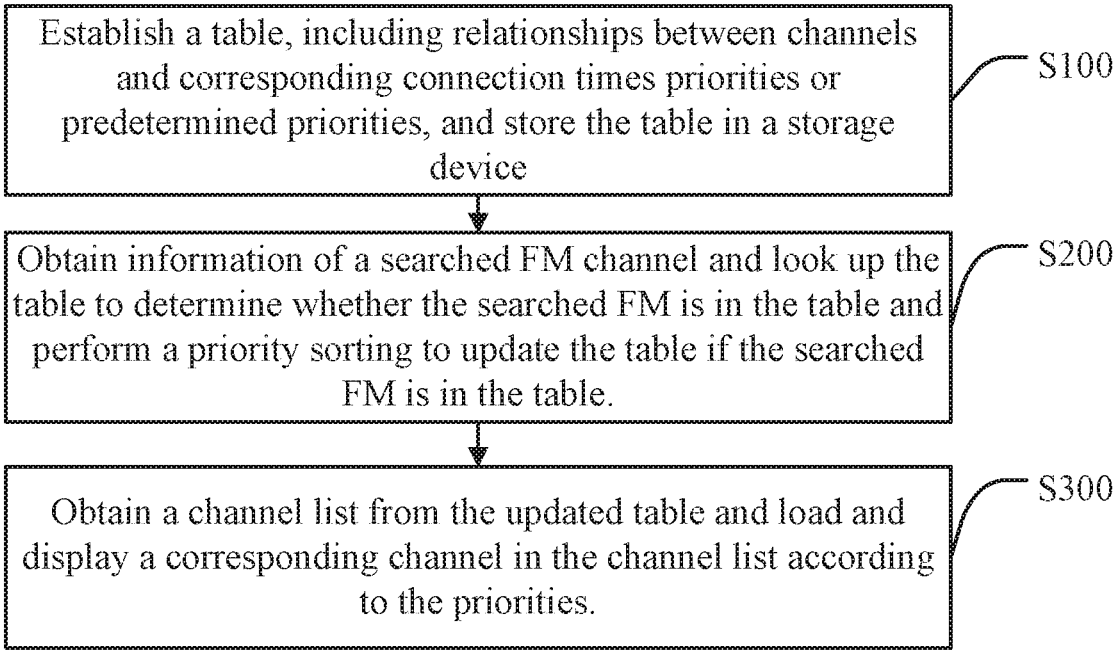
FIG. 1 is a flow chart of a method for looking up and searching for an FM channel according to an embodiment of the present invention.

The invention is described below in detail with reference to the accompanying drawings, wherein like reference numerals are used to identify like elements illustrated in one or more of the figures thereof, and in which exemplary embodiments of the invention are shown. This invention may, however, be embodied in many different forms and should not be construed as limited to the particular embodiments set forth herein. Rather, these embodiments are provided so that this disclosure will be thorough and complete, and will fully convey the scope of the invention to those skilled in the art.

Please refer to FIG. 1. FIG. 1 is a flow chart of a method for looking up and searching for an FM channel according to an embodiment of the present invention. The method comprises following steps:

Step S100: Establish a table, including relationships between channels and corresponding connection times priorities or predetermined priorities, and store the table in a storage device.

In this embodiment, the setting of the priorities is based on the connection times of the channels. Specifically, the channel having the most connection times could be set as a top priority. The channel having the least connection times could be set as a lowest priority. The other channels could be set as different priorities from the most to the least according to the connection times of the other channels.

In this embodiment, there are two type of setting the priorities. One is to set according to the connection times. The other is to set according to the user's demands. Here, if there are multiple channels having predetermined higher priorities, then these channels are arranged in an order according to their predetermined priorities. Otherwise, the connection times of the channels determines the order of the channels. As previously mentioned, the channel having the most connection times could be set as the top priority. For example, the table including the relationships between channels and corresponding connection times priorities or predetermined priorities could be as below:

| Channel | Connection times | Predetermined priority | Priority order |
|---|---|---|---|
| 90.1 MHZ | 500 | 2 | 5 |
| 88.1 MHZ | 201 | 1 | 4 |
| 108 MHZ | 101 | N/A | 3 |
| 110 MHZ | 100 | N/A | 2 |
| 105 MHZ | 80 | N/A | 1 |

Specifically, the step S100 comprises:

Step S101: Pre-calculate connection times of the channels in the mobile terminal and set the priorities from most to least according to the connection times.

Step S102: Establish the table, including the relationships between the channels and the corresponding connection times priorities or the predetermined priorities according to the connection times of the channels.

Step S103: Store the table in a storage of the mobile terminal.

In addition, the method further comprises:

Step S200: Obtain information of a searched FM channel and look up the table to determine whether the searched FM is in the table and perform a priority sorting to update the table if the searched FM is in the table.

Specifically, when the user utilizes the mobile terminal to turn on the radio function of the FM radio, the search function for searching for FM channels are performed. After obtaining the information of the searched FM channel, the mobile terminal could look up the table. For example, the searched FM channel could be 110 MHz. Then, from the above table, the mobile terminal could know that this FM channel is in the table and its corresponding priority is 2. Thus, the mobile terminal could perform the priority sorting according to the table.

The step S200 comprises:

Step S201: Utilize the mobile terminal to receive a user command to turn on a radio function of an FM radio to start a search of FM channels.

Step S202: Utilize the mobile terminal to obtain information of the searched FM channel and look up the table to find the FM channel.

Step S203: Determine whether the searched FM channel is in the table and perform the priority sorting to update the table if the searched FM is in the table.

The step S200 further comprises: if the searched FM channel is not in the table, then perform a sorting operation according to a search order.

Furthermore, the method further comprises:

Step S300: Obtain a channel list from the updated table and load and display a corresponding channel in the channel list according to the priorities.

Specifically, the channel list is updated according to the priority order such that the display order of the channel list is based on the connection times of the channels. That is, a channel having more connection times will be displayed in the front. Here, the connection times of a channel represents the frequency that the user utilizes the channel. Therefore, it is more convenient for the user to look up and search for this channel if the channel is arranged in the front. After the channel list is updated, the mobile terminal load the channels in the channel list and display the channels of the channel list to allow the user to look up and easily select any one of the channels.

In addition, the Step S300 comprises:

Step S301: Obtain the channel list in the updated table according to the updated table.

Step S302: Load and display the corresponding channel in the channel list for a user to select an FM channel to perform a radio function.

Moreover, when the mobile terminal detects that the user is using a specific channel, the mobile terminal could revise the connection times of the specific channel and update the table accordingly. In this way, when mobile terminal detects that the user again performs the FM channel search, the mobile terminal could look up the latest updated table.

Specifically, when the number of the channel is too large, the table should be updated in time to allow the user quickly look up and search for the wanted channel. That is, when the user is using a specific channel, the connection times of the specific channel might need to be immediately updated. In this way, the speedy search or smart search for the channel could be achieved to raise the efficiency of looking up and searching for the channel and the user could easily and quickly search for the channel.

Therefore, the present invention could solve one issue of the conventional art. That is, the conventional art arranges the channels in the table in a fixed order. In the conventional art, when the number of channels is too large, the user cannot quickly look up and search for the wanted channel and thus it's not very convenient to the user.

In addition, the present invention could solve another issue of the convention art. That is, in the conventional art, when the FM application is activated, the conventional application often turns on the channel that the user used at last time. However, in some scenarios, the user needs to open the application and has to find the wanted channel as quickly as possible. As previously mentioned, the present invention allows the user to look up and search for the wanted channel very quickly even if the number of the channels is large.

Figure 2:
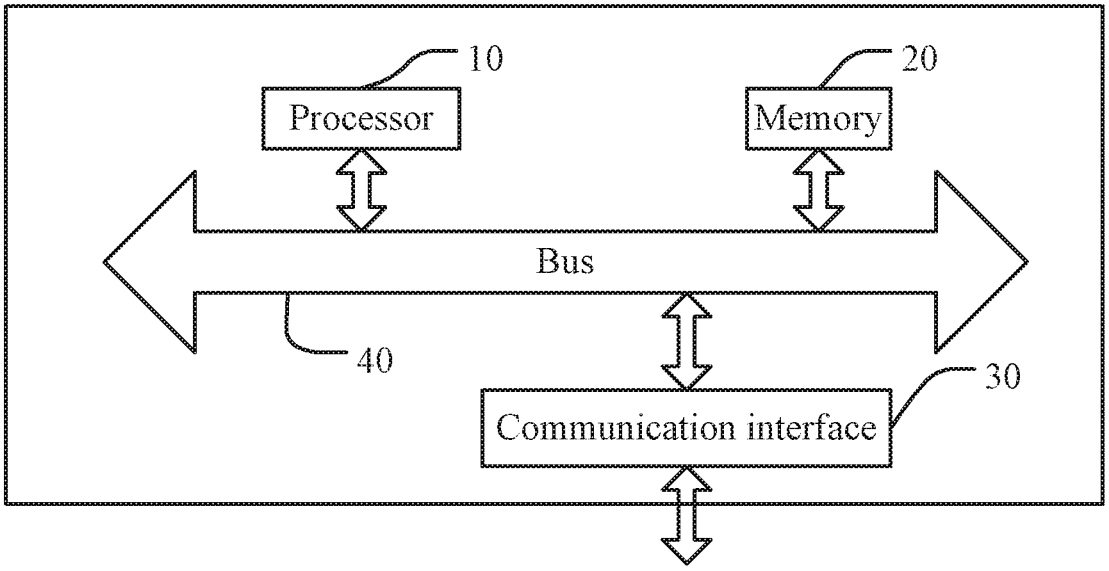
FIG. 2 is a functional block diagram of a mobile terminal according to an embodiment of the present invention.

Please refer to FIG. 2. FIG. 2 is a functional block diagram of a mobile terminal according to an embodiment of the present invention. The mobile terminal comprises a processor 10, a memory 20, a communication interface 30 and a bus 40. The processor 10, the memory 20, and the communication interface 30 communicate with each other through the bus 40. The communication interface 30 is used for information transmission between communication equipments of the mobile terminal.

The processor 10 is used to load the programs stored in the memory 20 to execute the programs to perform the method of the above embodiments. For example, the method could comprise establishing a table, including relationships between channels and corresponding connection times priorities or predetermined priorities, and storing the table in a storage device; obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

Figure 3:
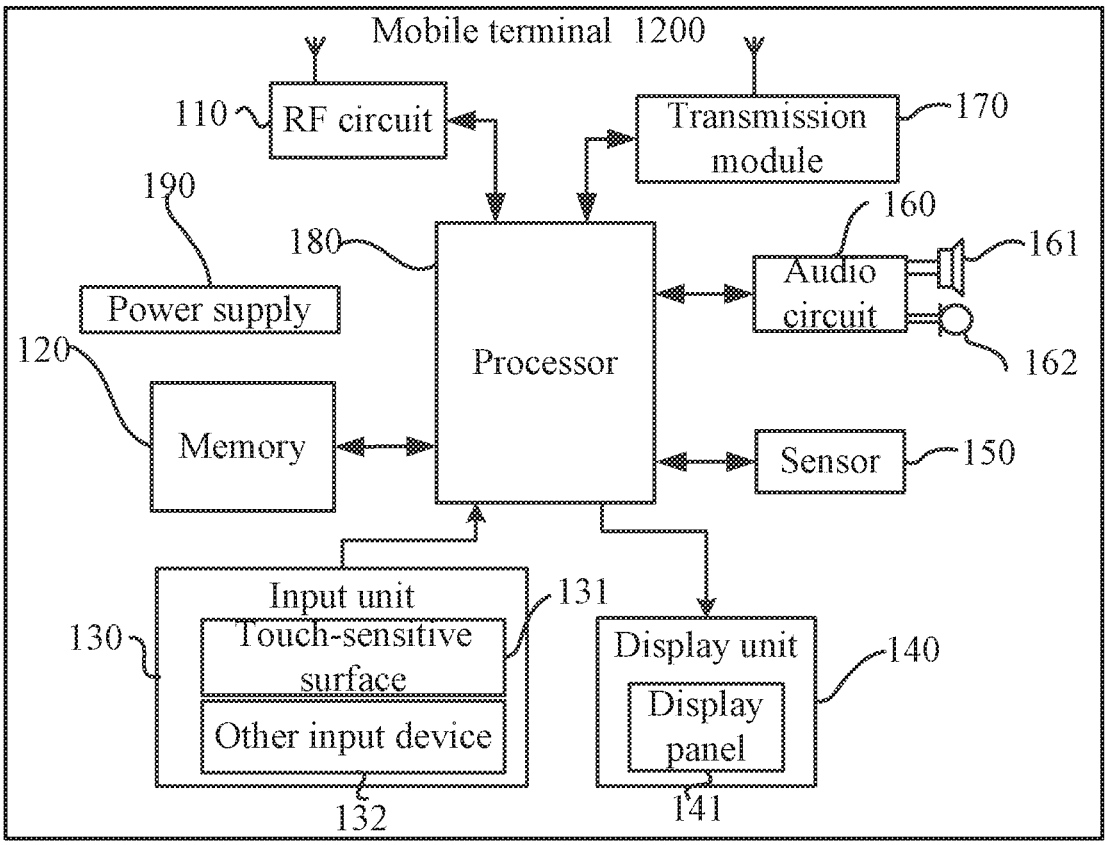
FIG. 3 is a diagram of a structure of a mobile terminal according to an embodiment of the present invention.

FIG. 3 is a diagram of a structure of a mobile terminal according to an embodiment of the present invention. The mobile terminal could be used to implement the above-mentioned method for looking up and searching for an FM channel. The mobile terminal 1200 could be a smart phone or a tablet.

As shown in FIG. 3, the mobile terminal 1200 may comprise components, such as a radio frequency (RF) circuit 110, a memory 120 including one or more (only one is shown in the figure) computer-readable storage media, an input unit 130, a display unit 140, a sensor 150, an audio circuit 160, a transmission module 170, a processor 180 including one or more (only one is shown in the figure) processing cores, and a power supply 190, etc. Those skilled in the art would understand that the mobile terminal 1200 is not limited to the structure of the mobile terminal 1200 shown in FIG. 3. The mobile terminal 1200 may comprise more or less components than those illustrated in the figure, or some components may be combined, or may have different components arrangements.

The RF circuit 110 may be configured to receive and send a signal during an information receiving and sending process or a conversation process. Specifically, after receiving downlink information from a base station, the RF circuit 110 delivers the downlink information to one or more processors 180 for processing, and sends related uplink data to the base station. Generally, the RF circuit 110 includes, but is not limited to, an antenna, at least one amplifier, a tuner, one or more oscillators, a subscriber identity module (SIM) card, a transceiver, a coupler, a low noise amplifier (LNA), and a duplexer. In addition, the RF circuit 110 may also communicate with a network and another device by wireless communication. The wireless communication may use any communications standard or protocol, which includes, but is not limited to, a Global System for Mobile communications (GSM), an Enhanced Data GSM Environment (EDGE), a Wideband Code Division Multiple Access (WCDMA), a Code Division Access (CDMA), a Time Division Multiple Access (TDMA), a Wireless Fidelity (Wi-Fi) such as IEEE 802.11a, IEEE 802.11b, IEEE802.11g and IEEE 802.11n, a Voice over Internet Protocol (VoIP), a Worldwide Interoperability for Microwave Access (Wi-Max), any other protocols for e-mail, instant communication and short message, and the like.

The memory 120 may be configured to store a software program and module. The processor 180 runs the software program and module stored in the memory 120, to implement various functional applications and data processing. The memory 120 may mainly include a program storage area and a data storage area. The program storage area may store an operating system, an application program required by at least one function (such as a sound playback function and an image display function), and the like. The data storage area may store data (such as audio data and an address book) created according to use of the terminal 1200, and the like. In addition, the memory 120 may include a high speed random access memory, and may also include a non-volatile memory, such as at least one magnetic disk storage device, a flash memory device, or another volatile solid-state storage device. Correspondingly, the memory 120 may further include a memory controller, so that the processor 180 and the input unit 130 access the memory 120.

The input unit 130 may be configured to receive input digit or character information, and generate keyboard, mouse, joystick, optical, or track ball signal input related to the user setting and function control. Specifically, the input unit 130 may include a touch-sensitive surface 131 and other input device 132. The touch-sensitive surface 131 may also be referred to as a touch screen or a touch panel, and may collect a touch operation of a user on or near the touch-sensitive surface (such as an operation of a user on or near the touch-sensitive surface 131 by using any suitable object or attachment, such as a finger or a stylus), and drive a corresponding connection apparatus according to a preset program. Optionally, the touch-sensitive surface 131 may include two parts: a touch detection apparatus and a touch controller. The touch detection apparatus detects a touch position of the user, detects a signal generated by the touch operation, and transfers the signal to the touch controller. The touch controller receives the touch information from the touch detection apparatus, converts the touch information into touch point coordinates, and sends the touch point coordinates to the processor 180. Moreover, the touch controller can receive and execute a command sent from the processor 180. In addition, the touch-sensitive surface 131 may be implemented by using various types, such as a resistive type, a capacitance type, an infrared type, and a surface sound wave type. In addition to the touch-sensitive surface 131, the input unit 130 may further include the another input device 132. Specifically, the another input device 132 may include, but is not limited to, one or more of a physical keyboard, a functional key (such as a volume control key or a switch key), a track ball, a mouse, and a joystick.

The display unit 140 may be configured to display information input by the user or information provided for the user, and various graphical user ports of the terminal 1200. The graphical user ports may be formed by a graph, a text, an icon, a video, and any combination thereof. The display unit 140 may include a display panel 141. Optionally, the display panel 141 may be configured by using a liquid crystal display (LCD), an organic light-emitting diode (OLED), or the like. Further, the touch-sensitive surface 131 may cover the display panel 141. After detecting a touch operation on or near the touch-sensitive surface 131, the touch-sensitive surface 131 transfers the touch operation to the processor 180, so as to determine a type of a touch event. Then, the processor 180 provides corresponding visual output on the display panel 141 according to the type of the touch event. Although, in FIG. 3, the touch-sensitive surface 131 and the display panel 141 are used as two separate parts to implement input and output functions, in some embodiments, the touch-sensitive surface 131 and the display panel 141 may be integrated to implement the input and output functions.

The terminal 1200 may further include at least one sensor 150, such as an optical sensor, a motion sensor, and other sensors. Specifically, the optical sensor may include an ambient light sensor and a proximity sensor. The ambient light sensor may adjust luminance of the display panel 141 according to brightness of the ambient light. The proximity sensor may switch off the display panel 141 and/or backlight when the terminal 1200 is moved to the ear. As one type of motion sensor, a gravity acceleration sensor may detect magnitude of accelerations at various directions (which generally are triaxial), may detect magnitude and a direction of the gravity when static, and may be configured to identify an application of a mobile phone attitude (such as switching between horizontal and vertical screens, a related game, and attitude calibration of a magnetometer), a related function of vibration identification (such as a pedometer and a knock). Other sensors, such as a gyroscope, a barometer, a hygrometer, a thermometer, and an infrared sensor, which may be configured in the terminal 1200 are not further described herein.

The audio circuit 160, a loudspeaker 161, and a microphone 162 may provide audio interfaces between the user and the terminal 1200. The audio circuit 160 may transmit, to the loudspeaker 161, a received electric signal converted from received audio data. The loudspeaker 161 converts the electric signal into a sound signal for output. On the other hand, the microphone 162 converts a collected sound signal into an electric signal. The audio circuit 160 receives the electric signal and converts the electric signal into audio data, and outputs the audio data to the processor 180 for processing. Then, the processor 180 sends the audio data to, for example, another terminal by using the RF circuit 110, or outputs the audio data to the memory 120 for further processing. The audio circuit 160 may further include an earplug jack, so as to provide communication between a peripheral earphone and the terminal 1200.

The terminal 1200 may help, by using the transmission module 170 (e.g. Wi-Fi module), a user to receive and send an e-mail, browse a webpage, and access stream media, and the like, which provides wireless broadband Internet access for the user. Although FIG. 3 shows the transmission module 170, it may be understood that, the wireless communications unit is not a necessary component of the terminal 1200, and can be ignored according to demands without changing the scope of the essence of the present disclosure.

The processor 180 is a control center of the terminal 1200, and connects various parts of the terminal by using various interfaces and lines. By running or executing the software program and/or module stored in the memory 120, and invoking data stored in the memory 120, the processor 180 performs various functions and data processing of the terminal 1200, thereby performing overall monitoring on the mobile phone. Optionally, the processor 180 may include one or more processing cores. Preferably, the processor 180 may integrate an application processor and a modem. The application processor mainly processes an operating system, a user interface, an application program, and the like. The modem mainly processes wireless communication. It may be understood that, the foregoing modem may not be integrated into the processor 180.

The terminal 1200 further includes the power supply 190 (such as a battery) for supplying power to the components. Preferably, the power supply may be logically connected to the processor 180 by using a power supply management system, thereby implementing functions, such as charging, discharging, and power consumption management, by using the power supply management system. The power supply 190 may further include any component, such as one or more direct current or alternate current power supplies, a re-charging system, a power supply fault detection circuit, a power supply converter or an inverter, and a power supply state indicator.

Although it's not shown, the mobile terminal 1200 could further comprise a camera (such as front camera or back camera) or a Bluetooth module. In this embodiment, the display unit of the mobile terminal is a touch panel. The mobile terminal further comprises a storage device and one or more programs (instructions) stored in the storage device. These programs (instructions) are executed by one or more processors to perform one or more processors to perform operations of:

The mobile terminal comprises: a processor and a storage device electrically connected to the processor. The storage device stores programs for the processor to execute to perform operations of:

establishing a table, including relationships between channels and corresponding connection times priorities or predetermined priorities, and storing the table in a storage device;

obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

Optionally, the operation of establishing the table, including the relationships between the channels and the corresponding connection times priorities or the predetermined priorities, and storing the table in the storage device comprises:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

Optionally, the operation of setting the priorities from the most to the least according to the connection times comprises:

setting a channel having the most connection times as a top priority, setting a channel having the least connection times as a lowest priority, and setting other channels as different priorities from the most to the least according to the connection times of the other channels.

Optionally, the predetermined priority is set according to a user's setting a specific FM channel as a fixed priority.

Optionally, the operation of obtaining information of a searched FM channel and looking up the table to determine whether the searched FM is in the table and performing a priority sorting to update the table if the searched FM is in the table comprises:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

Optionally, operation of obtaining information of the searched FM channel and looking up the table to determine whether the searched FM is in the table and performing the priority sorting to update the table if the searched FM is in the table comprises:

if the searched FM channel is not in the table, then performing a sorting operation according to a search order.

Optionally, the operation of obtaining the channel list from the updated table and loading and displaying the corresponding channel in the channel list according to the priorities comprises:

obtaining the channel list in the updated table; and loading and displaying the corresponding channel in the channel list for a user to select an FM channel to perform a radio function.

Optionally, the operation of obtaining the channel list from the updated table and loading and displaying the corresponding channel in the channel list according to the priorities further comprises:

when detecting that a user is using a specific channel, revising the connection times of the specific channel and updating the table;

when the mobile terminal again detects that the user is performing the search of FM channels, performing a look up function according to the updated table.

According to an embodiment of the present invention, a storage device is disclosed. The storage device stores programs executable by a processor to perform operations of:

establishing a table, including relationships between channels and corresponding connection times priorities or predetermined priorities, and storing the table in a storage device;

obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

Optionally, the programs are executable by the processor to perform operations of:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

Optionally, the programs are executable by the processor to perform operations of:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

Optionally, the programs are executable by the processor to perform operations of:

obtaining the channel list in the updated table; and loading and displaying the corresponding channel in the channel list for a user to select an FM channel to perform a radio function.

From the above, one embodiment of the present invention could Establish a table, including relationships between channels and corresponding connection times priorities or predetermined priorities, and store the table in a storage device, obtain information of a searched FM channel and look up the table to determine whether the searched FM is in the table and perform a priority sorting to update the table if the searched FM is in the table; and obtain a channel list from the updated table and load and display a corresponding channel in the channel list according to the priorities. In addition, one embodiment of the present invention could establish a table, including relationships between channels and corresponding connection times priorities or predetermined priorities, performing a priority sorting on information of a searched FM channel according to the table, and obtain a channel list from the updated table and load and display a corresponding channel in the channel list. This raises the efficiency of looking up and searching for the FM channel and makes it more convenient for the user.

Please note, one or more steps of the above-mentioned method could be achieved by instructing related hardware components (such as processor or controllers) through one or more programs. The above-mentioned programs could be stored in a computer readable storage medium such as a memory, a hard disk, an optical disk or etc.

Above are embodiments of the present invention, which does not limit the scope of the present invention. Any modifications, equivalent replacements or improvements within the spirit and principles of the embodiment described above should be covered by the protected scope of the invention.

What is claimed is:

1. A method for looking-up and searching for a frequency modulation (FM) channel, the method comprising:

establishing a table, including relationships between channels and corresponding connection times priorities, according to connection times of the channels, and storing the table in a storage device;

obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

2. The method of claim 1, wherein the step of establishing the table, including the relationships between the channels and the corresponding connection times priorities or the predetermined priorities, and storing the table in the storage device comprises:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

3. The method of claim 1, wherein the step of setting the priorities from the most to the least according to the connection times comprises:

setting a channel having the most connection times as a top priority, setting a channel having the least connection times as a lowest priority, and setting other channels as different priorities from the most to the least according to the connection times of the other channels.

4. The method of claim 1, wherein the predetermined priority is set according to a user's setting a specific FM channel as a fixed priority.

5. The method of claim 1, wherein the step of obtaining information of a searched FM channel and looking up the table to determine whether the searched FM is in the table and performing a priority sorting to update the table if the searched FM is in the table comprises:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

6. The method of claim 5, wherein the step of obtaining the channel list from the updated table and loading and displaying the corresponding channel in the channel list according to the priorities comprises:

obtaining the channel list in the updated table; and loading and displaying the corresponding channel in the channel list for a user to select an FM channel to perform a radio function.

7. The method of claim 6, wherein the step of obtaining the channel list from the updated table and loading and displaying the corresponding channel in the channel list according to the priorities further comprises:

when detecting that a user is using a specific channel, revising the connection times of the specific channel and updating the table;

when the mobile terminal again detects that the user is performing the search of FM channels, performing a look up function according to the updated table.

8. The method of claim 1, wherein the step of obtaining information of the searched FM channel and looking up the table to determine whether the searched FM is in the table and performing the priority sorting to update the table if the searched FM is in the table comprises:

if the searched FM channel is not in the table, then performing a sorting operation according to a search order.

9. A mobile terminal, comprising:

a processor;

a storage device, electrically connected to the processor, configured to store programs for the processor to execute to operations of:

establishing a table, including relationships between channels and corresponding connection times priorities, according to connection times of the channels, and storing the table in a storage device;

obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

10. The mobile terminal of claim 9, wherein the operation of establishing the table, including the relationships between the channels and the corresponding connection times priorities or the predetermined priorities, and storing the table in the storage device comprises:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

11. The mobile terminal of claim 10, wherein the operation of setting the priorities from the most to the least according to the connection times comprises:

setting a channel having the most connection times as a top priority, setting a channel having the least connection times as a lowest priority, and setting other channels as different priorities from the most to the least according to the connection times of the other channels.

12. The mobile terminal of claim 10, wherein the predetermined priority is set according to a user's setting a specific FM channel as a fixed priority.

13. The mobile terminal of claim 9, wherein the operation of obtaining information of a searched FM channel and looking up the table to determine whether the searched FM is in the table and performing a priority sorting to update the table if the searched FM is in the table comprises:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

14. The mobile terminal of claim 13, wherein the operation of obtaining the channel list from the updated table and loading and displaying the corresponding channel in the channel list according to the priorities comprises:

obtaining the channel list in the updated table; and loading and displaying the corresponding channel in the channel list for a user to select an FM channel to perform a radio function.

15. The mobile terminal of claim 14, wherein the operation of obtaining the channel list from the updated table and loading and displaying the corresponding channel in the channel list according to the priorities further comprises:

when detecting that a user is using a specific channel, revising the connection times of the specific channel and updating the table;

when the mobile terminal again detects that the user is performing the search of FM channels, performing a look up function according to the updated table.

16. The mobile terminal of claim 9, wherein the operation of obtaining information of the searched FM channel and looking up the table to determine whether the searched FM is in the table and performing the priority sorting to update the table if the searched FM is in the table comprises:

if the searched FM channel is not in the table, then performing a sorting operation according to a search order.

17. A storage device, storing programs executable by a processor to perform operations of:

establishing a table, including relationships between channels and corresponding connection times priorities, according to connection times of the channels, and storing the table in a storage device;

obtaining information of a searched FM channel and looking up the table to determine whether the searched FM is in the table and performing a priority sorting to update the table if the searched FM is in the table; and obtaining a channel list from the updated table and loading and displaying a corresponding channel in the channel list according to the priorities.

18. The storage device of claim 17, wherein the programs are executable by the processor to perform operations of:

calculating connection times of the channels in the mobile terminal and setting the priorities from most to least according to the connection times;

establishing the table, including the relationships between the channels and the corresponding connection times priorities or the predetermined priorities according to the connection times of the channels; and storing the table in a storage of the mobile terminal.

19. The storage device of claim 17, wherein the programs are executable by the processor to perform operations of:

utilizing the mobile terminal to receive a user command to turn on a radio function of an FM radio to start a search of FM channels;

utilizing the mobile terminal to obtain information of the searched FM channel and look up the table to find the FM channel; and determining whether the searched FM channel is in the table and performing the priority sorting to update the table if the searched FM is in the table.

20. The storage device of claim 17, wherein the programs are executable by the processor to perform operations of:

obtaining the channel list in the updated table; and loading and displaying the corresponding channel in the channel list for a user to select an FM channel to perform a radio function.

* * * * *